US005137420A

United States Patent [19]

Sigworth et al.

[11] Patent Number: 5,137,420

[45] Date of Patent: Aug. 11, 1992

[54] COMPRESSIBLE BLADE ROOT SEALANT

[75] Inventors: Ronald L. Sigworth, Manchester, Conn.; Kevin B. McDonnell, Tequesta, Fla.

[73] Assignee: United Technologies Corporation, Hartford, Conn.

[21] Appl. No.: 584,819

[22] Filed: Sep. 14, 1990

[51] Int. Cl.[5] ..... F01D 11/00

[52] U.S. Cl. ..... 415/170.1; 416/248

[58] Field of Search ..... 416/248, 219 R, 500, 416/190; 415/170–171

[56] References Cited

U.S. PATENT DOCUMENTS

| | | | |
|---|---|---|---|
| 3,807,898 | 4/1974 | Guy et al. | 416/220 |
| 4,175,912 | 11/1979 | Crane et al. | 416/193 A |
| 4,389,161 | 6/1983 | Brumen | 416/220 R |
| 4,444,544 | 4/1984 | Rowley | 416/221 |
| 4,725,200 | 2/1988 | Welhoelter | 416/500 |
| 4,767,247 | 8/1988 | Partington et al. | 416/500 |

*Primary Examiner*—John T. Kwon

*Attorney, Agent, or Firm*—Herbert W. Mylius

[57] ABSTRACT

A seal is provided for preventing passage of working medium gases between the roots of the rotor blades of a gas turbine engine and the rotor thereof. The seal comprises a laminar exfoliated graphite piece placed in the cavity between the root of the rotor blade and the receiving slot in the rotor disk.

8 Claims, 5 Drawing Sheets

COMPRESSIBLE BLADE ROOT SEALANT

The invention was made under a U.S. Government contract and the Government has rights herein.

DESCRIPTION

1. Technical Field

The present invention relates to gas turbine engines, and particularly to compressor and turbine disks having blades mounted in the periphery thereof.

2. Background

Gas turbine assemblies commonly comprise a plurality of turbine and compressor blades, each of which is joined to a disk through the engagement of a fir tree or dove tail blade root in a corresponding disk slot and extends radially outward from the periphery of the disk, across the path of working medium gases flowing through the engine. Due to the advent of high performance engines, and particularly in light of the concern for fuel conservation, there has been an increasing desire to avoid air leakages within the engine. Obviously, any leakage constitutes a loss of energy, efficiency, and fuel economy. This invention relates to the sealing of the gap between the blade root of each rotor blade and the slot in which it is mounted in the disk.

In the past, attempts to reduce this source of leakage have included sealant materials such as silicon rubber compositions, which are temperature limited, and epoxy cements. These solutions have had problems of maintainability and blade removal, since removal of such materials or their residues is a labor intensive and difficult process. Other approaches to the reduction of leakage between blade root and disk have included providing sealing means at the disk surface, which also provide means to lock the blade root in position in the disk. An example of such a bladed rotor assembly is shown in U.S. Pat. No. 3,807,898, of Guy et al. In this assembly, a plurality of sealing plates extend from the rotor disk to each rotor blade platform, to lock the blades in place and to block leakage between the platforms and the disk. Another locking device is illustrated in commonly owned U.S. Pat. Nos. 4,389,161 and 4,444,544, of Brumen and Rowley, respectively, which are incorporated herein by reference. According to these references, each rotor blade is retained against fore and aft movement by a lock pin, which also serves to block the leakage of working medium gases through the blade attachment slot across the disk. The present invention is particularly advantageous in conjunction with locking means such as taught by these references.

SUMMARY OF THE INVENTION

It is an object of the present invention to provide a simple, cost effective, and efficient means to provide a seal against leakage between the blade roots and disk of a rotor assembly. It is a further object of this invention to provide a seal which is reusable, maintainable, and easily replaced. It is still another object of the invention to provide a means for sealing cavities formed in gas turbine assemblies where loose fitting parts result in the formation of a passageway for working medium gases. Accordingly, it is to be understood that while the present disclosure is presented in terms of the sealing of blade root cavities, the present invention is meant to encompass other similar cavities, such as that formed between a stator and the outer case of a turbine.

These and other objects have been achieved by the provision of a laminar graphite sealing means, which is sized to fit precisely within the cavity between the blade root and the blade attachment slot in the disk. In a preferred embodiment, the sealing means is press molded to a specific configuration or chamfered to permit ease of assembly.

These and other objects and advantages of the invention will become more readily understood through reference to the following description of the drawings and preferred embodiments.

DETAILED DESCRIPTION OF THE INVENTION

Figure 1:
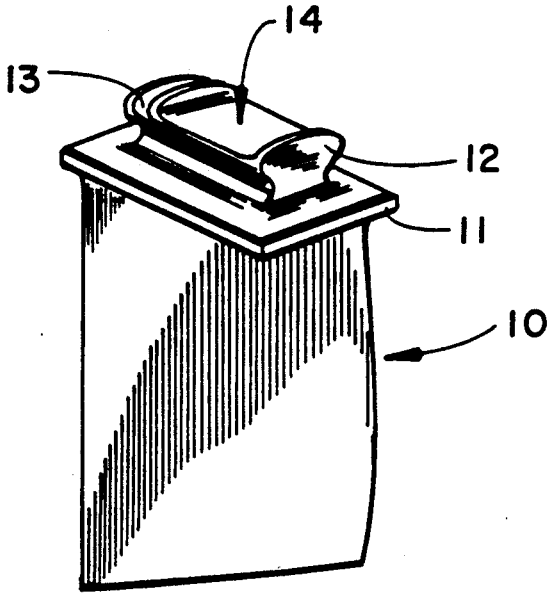
FIG. 1 is a perspective of a compressor rotor blade such as is employed in the present invention.

The concept of the invention is clearly illustrated in the Figures, and particularly in FIGS. 1, 2, 3, and 4. In FIG. 1, a rotor blade 10 is shown, with platform 11, and blade root 12. As shown in this figure, the blade root may have a groove 13, adapted to accept a lock pin or locking snap ring (not shown) upon assembly, and a seal mounting surface, 14, of such configuration to accept the compressible seal means, illustrated in FIG. 2. The base of the blade root, 12, need not be as illustrated, but may also be of a fir tree configuration, or having a smooth inner diameter surface without a specific seal mounting surface or groove for a locking mechanism.

Figure 2:
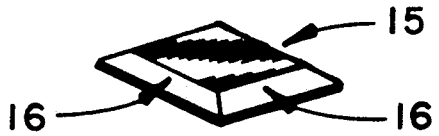
FIG. 2 is a perspective view of a preferred sealing means in accordance with the present invention.

The compressible seal means 15 of this invention is illustrated in FIG. 2, wherein it is shown in a preferred configuration, having chamfered surfaces 16. While the present invention is intended to encompass the use of seals having no chamfers, e.g. flat or rounded seal edges, it has been found to be highly advantageous to chamfer or bevel at least the leading edge of the seal for ease of insertion into the receiving slot in the disk. The compressible seal is of a laminar graphite material, comprising multiple thin layers of exfoliated graphite. A preferred form of this material is marketed under the trademark GRAFOIL® Flexible Graphite, by Union Carbide Corporation. Such material is flexible, compactible, and resilient, and may be easily cut or shaped to the desired configuration. In addition, graphite offers thermal stability up to temperatures in excess of 2000° F., thermal conductivity, and natural lubricity. Other similar graphite sheet or laminar materials, suitable for gasketing or fluid sealing utility, may also be used.

Figure 3:
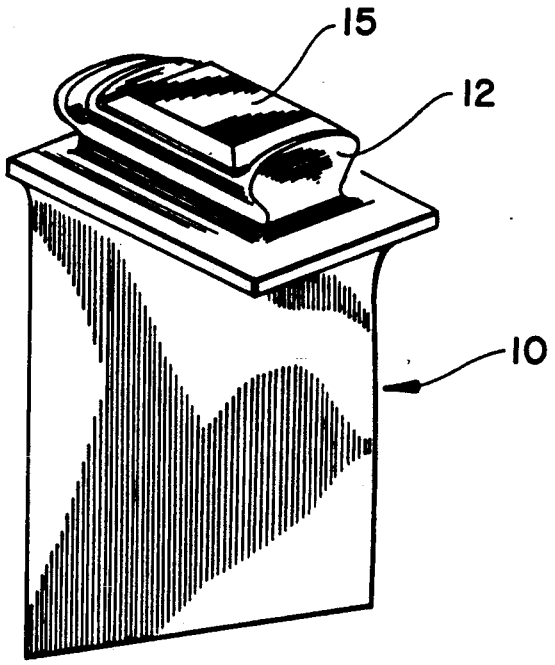
FIG. 3 is a perspective view of a rotor blade and sealing means, showing their relationship.

As illustrated in FIG. 3, the graphite seal material is placed on the seal mounting surface 14 of the blade root 12 for insertion into the blade receiving slot of the disk. For ease of assembly, the graphite seal may be adhesively mounted, such as with double faced tape, Eastman 910 Adhesive (a trademark of Eastman Kodak Company), or like means. In this manner, the rotor blade assembly, with the compressible seal in place, may be easily handled for insertion in the disk. The adhesive means selected should preferably be such that it burns off at a relatively low temperature, e.g. 200° F., leaving no residue.

Figure 4:
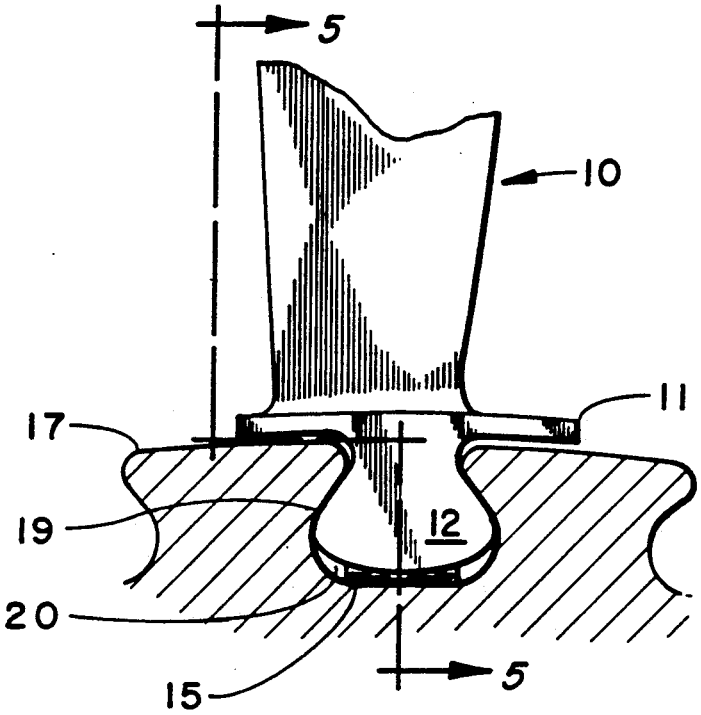
FIG. 4 is an end view of a rotor blade and sealing means mounted in a disk slot.

Shown in end view in FIG. 4, the blade root 12, inserted into receiving slot 19 in the disk 17, forms a cavity 20. The compressible graphite seal 15 of this invention is located within this cavity so as to prevent leakage of working gases.

Figure 5:
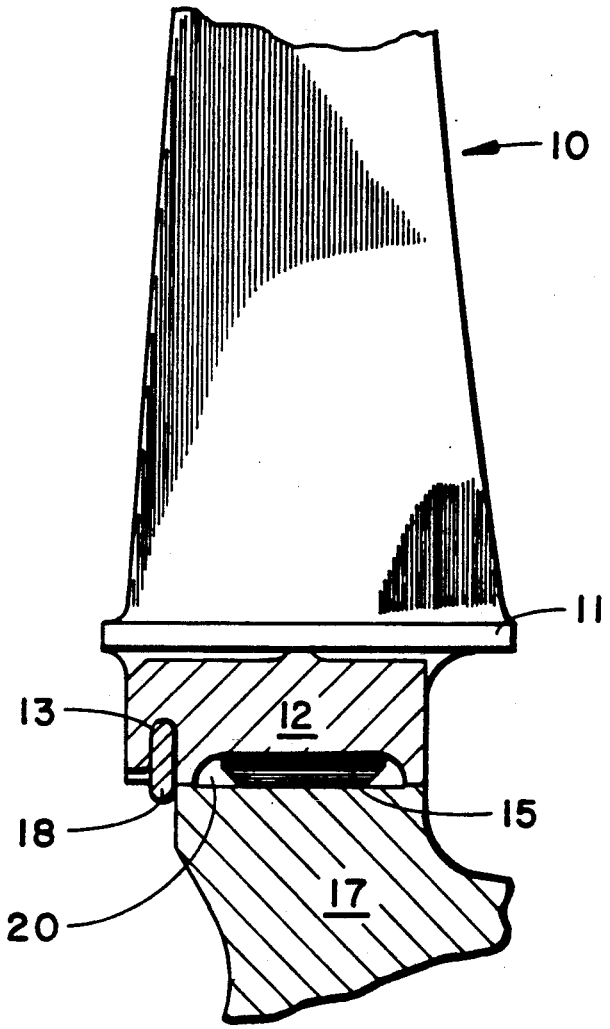
FIG. 5 is a cross section of a rotor blade and sealing means mounted in a disk slot, showing the position of the compressible seal of the present invention.

As shown in FIG. 5, a cross section taken at line 5—5 of FIG. 4, compressible seal 15 is positioned between the blade root 12 of blade 10 and the disk 17, in the cavity 20 formed between said blade root and the slot in the disk. A locking pin or retaining ring 18 is shown in groove 13, but this is not a necessary part of the present invention.

Figure 6:
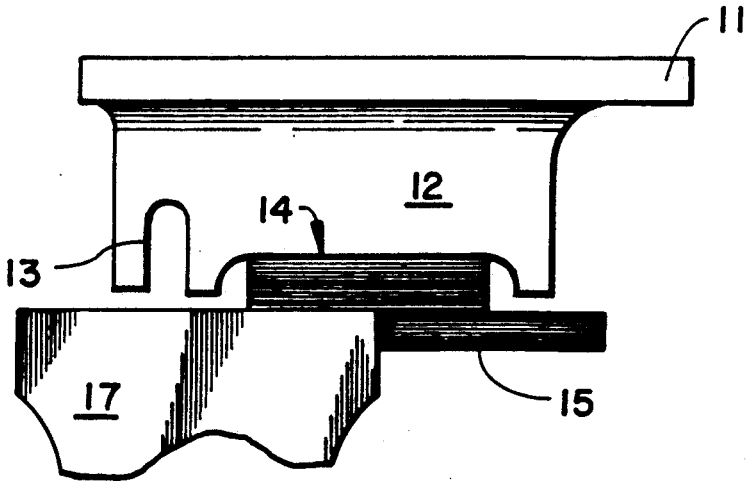
FIG. 6 shows a compressible seal which is not chamfered to provide ease of installation, and the result of installation in a tight fitting disk slot.

As previously indicated, it has been found extremely beneficial to bevel or chamfer at least the leading edge of the laminar graphite seal material, relative to the direction of insertion into the blade root receiving slot of the disk. If the leading edge is not chamfered as indicated, that surface will be delaminated by the edge of the receiving slot when the blade root is inserted, as shown schematically in FIG. 6. When such delamination occurs, the seal is less effective and more subject to separation and leakage.

Figure 7:
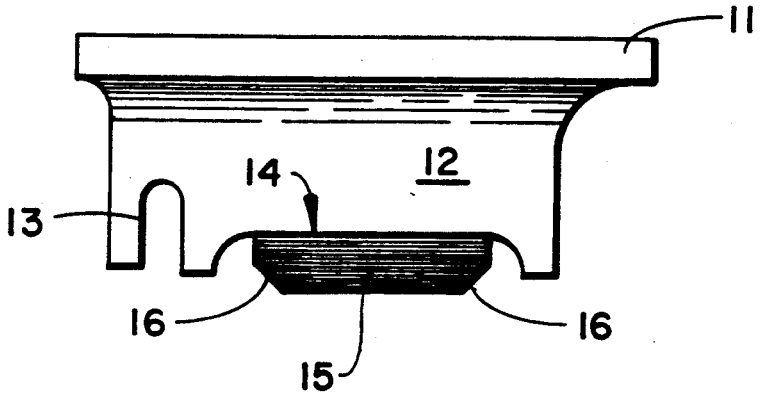
FIG. 7 illustrates a compressible seal which is chamfered for ease of installation.
Figure 8:
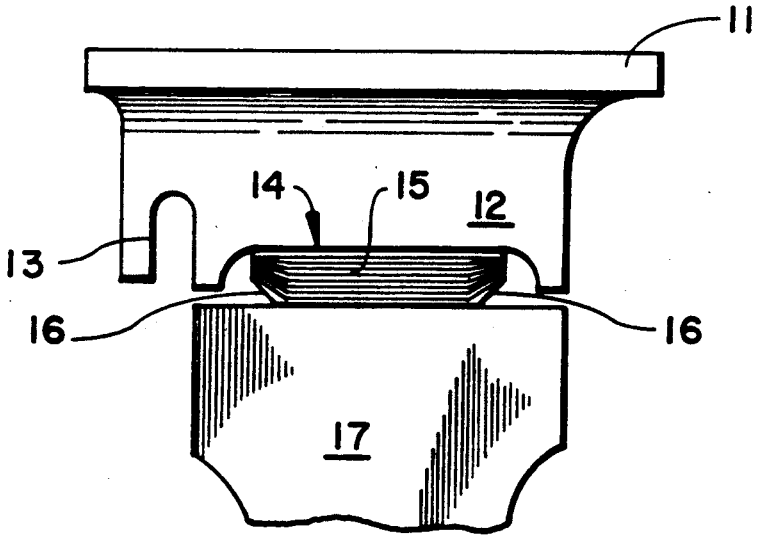
FIG. 8 illustrates a press molded seal.

A suitable form of laminated graphite material is chamfered or cut at assembly, as illustrated in FIG. 7, showing seal 15 mounted on surface 14 of blade root 12, and having chamfered surfaces 16 cut therein. The preferred form of the laminar graphite seal 15 of the present invention is that which is press-molded to a configuration having chamfered edges 16 as illustrated in FIG. 8. Due to the natural lubricity of graphite, and the compressibility of the exfoliated graphite of the seal material, the chamfered surfaces 16 permit the insertion of the blade root into the slot in the disk 17, with the leading edge of the slot sliding over the chamfered surface 16 without causing any tearing or delamination of the seal. Press-molding is also believed to align the graphite layers of the material, and to produce a higher density seal.

Compressible seals as set forth above were formed by press-molding a sheet of GRAFOIL ® laminated exfoliated flexible graphite to the configuration shown in FIG. 2, having chamfered edges all around. These seals were bonded to axially slotted blades such as shown in FIG. 1, using Eastman 910 Adhesive, an acrylic based adhesive of Eastman Kodak Co., and the assemblies were inserted into the receiving slots of the rotor disks of stages 6 and 7 of the high compressor of a gas turbine engine. The gas seals thus formed were found to withstand the operating temperatures of the compressor, and to provide a significant compressor efficiency benefit of at least 0.14 percent upon testing.

It is to be understood that the above description of the present invention is subject to considerable modification, change, and adaptation by those skilled in the art, and that such modifications, changes, and adaptations are to be considered to be within the scope of the present invention, which is set forth by the appended claims.

We claim:

1. In combination, a rotor disk having slots provided in the periphery thereof, rotor blades, said rotor blades having root portions shaped to fit the slots in the periphery of said disk, thereby creating cavities between said blade roots and said slots, and sealing means adapted to fit within said cavities, said sealing means comprising laminar graphite material.

2. A combination as set forth in claim 1, wherein said sealing means are essentially pure graphite.

3. A combination as set forth in claim 2, wherein the edges of said sealing means are chamfered.

4. A combination as set forth in claim 1, wherein said sealing means are adapted to prevent leakage of working gases between said blade roots and said slots.

5. A combination as set forth in claim 4, wherein said sealing means are formed by press-molding sheet material.

6. A combination as set forth in claim 5, wherein said sealing means are bonded to said blade root portions.

7. A combination as set forth in claim 6, wherein said sealing means are compressed when said blade root portions are placed in said slots in said disk.

8. A combination as set forth in claim 7, wherein the edges of said slots slide over said chamfered edges of said sealing means.

* * * * *